US011118496B2

(12) United States Patent
Carper et al.

(10) Patent No.: US 11,118,496 B2
(45) Date of Patent: Sep. 14, 2021

(54) EXHAUST TREATMENT DEVICE WITH MULTIPLE SUBSTRATES

(71) Applicant: Tenneco Automotive Operating Company Inc., Lake Forest, IL (US)

(72) Inventors: Scott D. Carper, Grass Lake, MI (US); Sakib R. Kazi, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 271 days.

(21) Appl. No.: 16/515,271

(22) Filed: Jul. 18, 2019

(65) Prior Publication Data

US 2021/0017894 A1 Jan. 21, 2021

(51) Int. Cl.
*F01N 13/18* (2010.01)

(52) U.S. Cl.
CPC ..... *F01N 13/1888* (2013.01); *F01N 13/1805* (2013.01); *F01N 13/1838* (2013.01)

(58) Field of Classification Search
CPC ..... F01N 14/1805; F01N 13/1888; F01N 2470/20; F01N 13/1872; F01N 13/0097
USPC ..... 422/177, 180
See application file for complete search history.

(56) References Cited

U.S. PATENT DOCUMENTS 6,821,639 B2 * 11/2004 Kato ..... F01N 3/2842 228/181
7,384,613 B2 6/2008 Prommersberger et al.
7,823,285 B2 11/2010 Cai et al.
8,241,578 B2 8/2012 Kim
8,795,598 B2 8/2014 Lawrukovich
9,833,831 B2 * 12/2017 Hijazi ..... B23P 19/00
10,213,778 B2 2/2019 Jang
2004/0234427 A1 * 11/2004 Tursky ..... F01N 3/2853 422/177
2006/0024215 A1 * 2/2006 Kroner ..... F01N 3/2853 422/179
2007/0160510 A1 * 7/2007 Schultz ..... B21J 5/066 422/177

(Continued)

FOREIGN PATENT DOCUMENTS

DE 102005019182 A1 10/2006
EP 1361347 B1 1/2005

(Continued)

*Primary Examiner* — Tom P Duong
(74) *Attorney, Agent, or Firm* — Harness, Dickey & Pierce, P.L.C.

(57) ABSTRACT

A single-piece tubular shell for an exhaust device includes a first peripheral wall portion, a second peripheral wall portion, and a third peripheral wall portion. The first peripheral wall portion at least partially defines a first interior region having a first longitudinal axis extending therethrough. The second peripheral wall portion at least partially defines a second interior region having a second longitudinal axis extending therethrough. The second longitudinal axis is non-coaxially aligned with the first longitudinal axis. The third peripheral wall portion extends between and connects the first peripheral wall portion and the second peripheral wall portion such that the first interior region and the second interior region are in fluid communication. The first peripheral wall portion, the second peripheral wall portion, and the third peripheral wall portion are integrally formed and define an uninterrupted, smooth shell inner surface.

20 Claims, 6 Drawing Sheets

(56) References Cited

U.S. PATENT DOCUMENTS

| | | | | |
|---|---|---|---|---|
| 2014/0366513 | A1* | 12/2014 | Mueller-Haas | F01N 3/2803 60/295 |
| 2017/0159537 | A1* | 6/2017 | Liu | B21J 5/066 |

FOREIGN PATENT DOCUMENTS

| | | | |
|---|---|---|---|
| EP | 1715154 | B1 | 6/2009 |
| EP | 2194252 | B1 | 2/2012 |

* cited by examiner

EXHAUST TREATMENT DEVICE WITH MULTIPLE SUBSTRATES

FIELD

The present disclosure relates to exhaust treatment devices having multiple substrates, shells for the exhaust treatment devices, and methods of manufacturing the shells.

BACKGROUND

This section provides background information related to the present disclosure which is not necessarily prior art.

An exhaust treatment system for an internal combustion engine can include exhaust treatment devices such as gasoline particulate filters (GPF), diesel particulate filters (DPF), diesel oxidation catalysts (DOC), lean NOx traps (LNT), and selective catalytic reduction devices (SCR). Many exhaust treatment systems include multiple components that are fluidly connected to one another. For example, an exhaust treatment system may include two or more components disposed in a common housing assembly. Depending on packaging requirements and desired performance characteristics, the two components may have different dimensions (e.g., diameters) and/or extend along respective longitudinal axes that are offset.

SUMMARY

This section provides a general summary of the disclosure, and is not a comprehensive disclosure of its full scope or all of its features.

The present disclosure provides an exhaust treatment device for receiving exhaust gas from an engine of a vehicle. The exhaust treatment device includes a tubular single-piece shell, a first exhaust treatment component, and a second exhaust treatment component. The tubular single-piece shell includes a first peripheral wall portion, a second peripheral wall portion, and a third peripheral wall portion. The first peripheral wall portion at least partially defines a first interior region having a first longitudinal axis extending therethrough. The second peripheral wall portion at least partially defines a second interior region having a second longitudinal axis extending therethrough. The second longitudinal axis is non-coaxially aligned with the first longitudinal axis. The third peripheral wall portion extends between and connects the first peripheral wall portion and the second peripheral wall portion such that the first interior region and the second interior region are in fluid communication. The first peripheral wall portion, the second peripheral wall portion, and the third peripheral wall portion are integrally formed and define a uninterrupted, smooth shell inner surface. The first exhaust treatment component is disposed within the first interior region. The second exhaust treatment component is disposed within the second interior region. The first interior region is in fluid communication with an inlet opening adapted to receive exhaust gas and the second interior region is in fluid communication with an outlet opening adapted to discharge exhaust gas.

In some configurations, the first peripheral wall portion has a first transverse inner dimension and the second peripheral wall portion has a second transverse inner dimension different from the first transverse inner dimension.

In some configurations, the third peripheral wall portion is sloped between the first peripheral wall portion and the second peripheral wall portion such that it extends non-parallel to the first longitudinal axis and the second longitudinal axis.

In some configurations, the first longitudinal axis extends parallel to and offset from the second longitudinal axis.

In some configurations, the first peripheral wall portion has a first transverse outer dimension and the second peripheral wall portion has a second transverse outer dimension different from the first transverse outer dimension.

In some configurations, the first peripheral wall portion and the second peripheral wall portion are substantially cylindrical.

In some configurations, the third peripheral wall has a substantially circular cross section.

In some configurations, the first peripheral wall portion, the second peripheral wall portion, and the third peripheral wall portion cooperate to form a shell wall having a maximum thinning ratio of less than or equal to about 25%.

In some configurations, the maximum thinning ratio is less than or equal to about 10%.

In some configurations, the shell further comprises a fourth peripheral wall portion and a fifth peripheral wall portion. The fourth peripheral wall portion at least partially defines a third interior region having a third longitudinal axis extending therethrough. The third longitudinal axis is non-coaxially aligned with at least one of the first longitudinal axis and the second longitudinal axis. The fifth peripheral wall portion extends between and connects the first peripheral wall portion and the fourth peripheral wall portion. The first peripheral wall portion, the second peripheral wall portion, the third peripheral wall portion, the fourth peripheral wall portion, and the fifth peripheral wall portion are integrally formed and define the uninterrupted, smooth shell inner surface.

In some configurations, the first exhaust treatment component and the second exhaust treatment component are independently selected from the group consisting of a gasoline particulate filter, a diesel particulate filter, a diesel oxidation catalyst, a lean NOx trap, a selective catalytic reduction device, or any combination thereof.

The present disclosure provides a method of manufacturing a shell for an exhaust treatment device. The method includes restricting movement of a first end of a monolithic tube. The monolithic tube has an inner surface, an outer surface, and a first longitudinal axis. The method further includes clamping a first portion of the tube within a first clamp die having a first clamp axis extending therethrough. The first longitudinal axis of the tube is substantially aligned with the first clamp axis. An inner surface of the first clamp die engages the outer surface of the tube along the first portion. The method further includes disposing a second portion of the tube within a second clamp die. An inner clamp surface of the second clamp die is spaced apart from the outer surface of the tube along the second portion. The second clamp die has a second clamp axis extending therethrough. The second clamp axis is non-coaxially aligned with the first clamp axis. The method further includes translating a tool into a second end of the tube opposite the first end of the tube. The method further includes deforming the tube while continuing to translate the tool and operatively engaging the tool with the inner surface of the tube such that the inner surface conforms to a first outer tool surface. The tool deforms the tube to conform the outer surface of the tube along the second portion to the inner clamp surface of the second clamp die, and substantially aligns a second longitudinal axis of the second portion with the second clamp axis. The method further includes removing the tool from the tube. The method further includes removing the tube from the first clamp die and the second clamp die.

In some configurations, the second clamp die is longitudinally spaced apart from the first clamp die.

In some configurations, deforming the tube further comprises operatively engaging the tool with a third portion of the tube such that the inner surface of the tube along the third portion conforms to a second outer tool surface. The third portion is disposed longitudinally between the first portion and the second portion.

In some configurations, the outer surface of the tube along the third portion is unconstrained during creating the shell.

In some configurations, the tube defines a wall thickness. Deforming the tube yields a thinning ratio of less than or equal to about 10%.

In some configurations, the method further includes maintaining a first inner dimension of the first portion of the tube during translation of the tool.

In some configurations, deforming the tube includes radially outwardly expanding all portions of the second portion of the tube.

In some configurations, deforming the tube includes expanding a first circumferential portion of the second portion of the tube to a lesser extent than a second circumferential portion of the tube.

In some configurations, deforming the tube includes transversely shifting the second portion of the tube from the first longitudinal axis to the second longitudinal axis. The second longitudinal axis is non-coaxially aligned with the first longitudinal axis.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
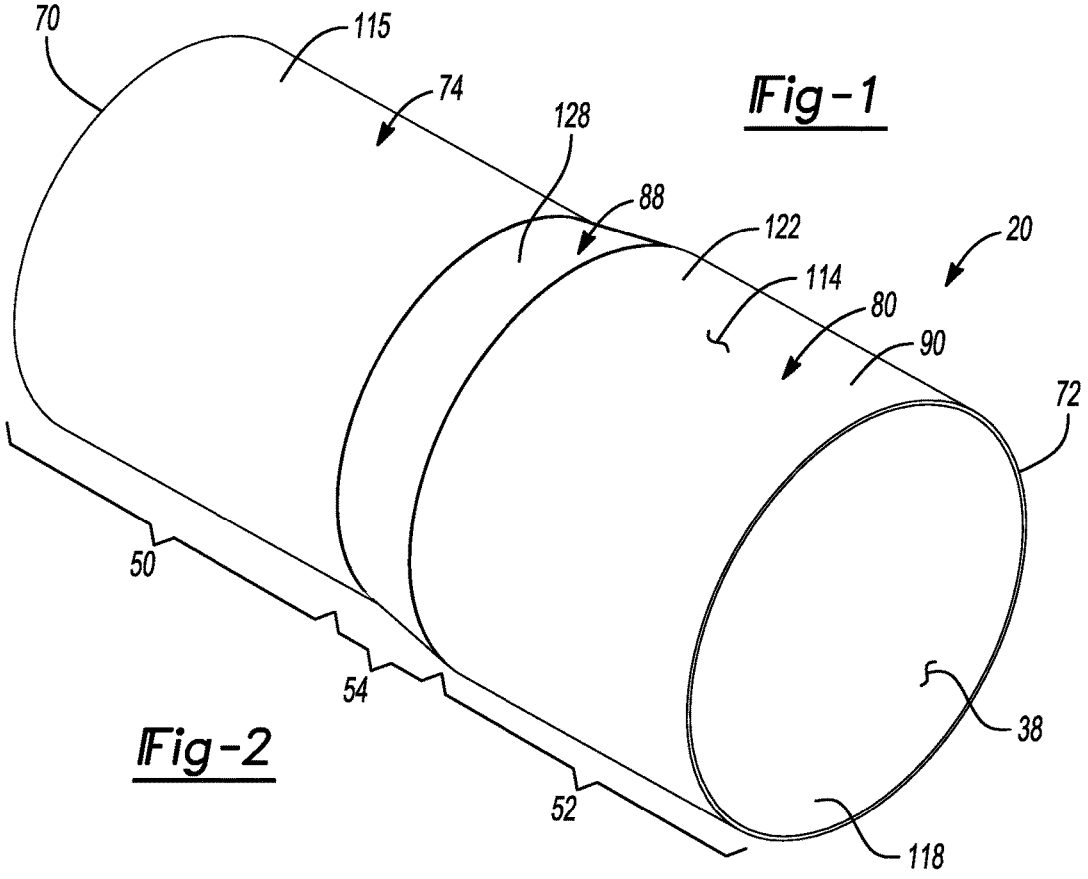
FIG. 2 is a perspective view of a shell of the exhaust treatment device of FIG. 1.
Figure 6:
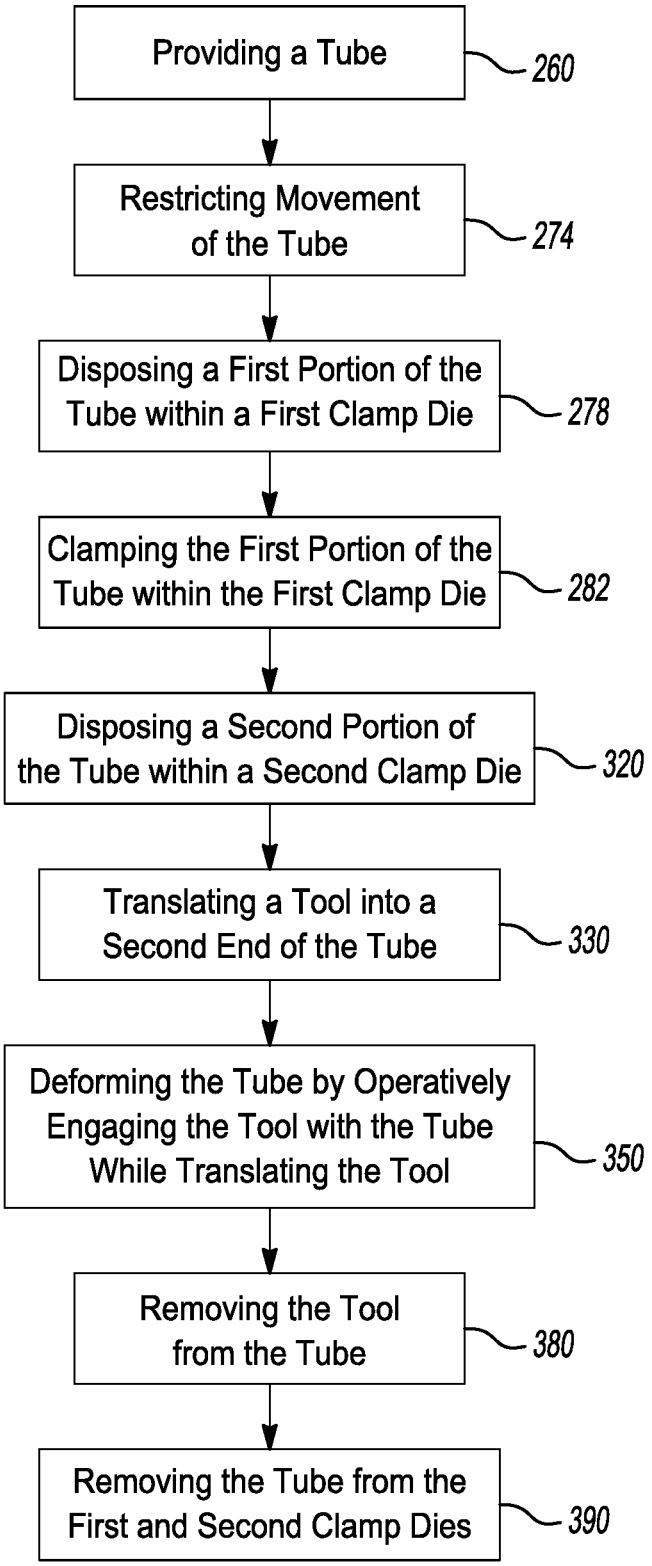
Figure 7:
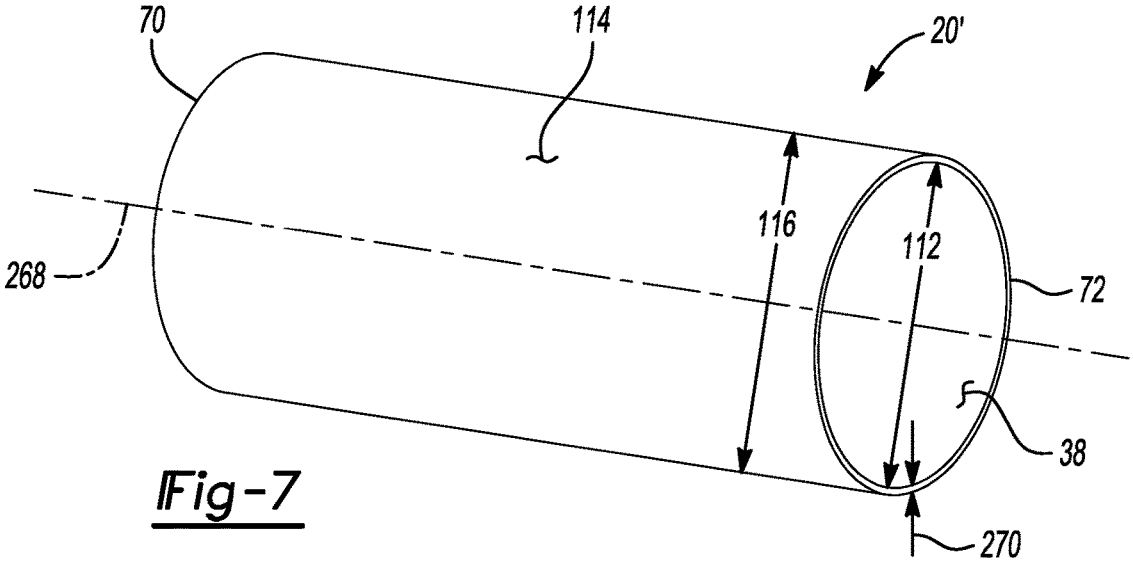
Figure 8:
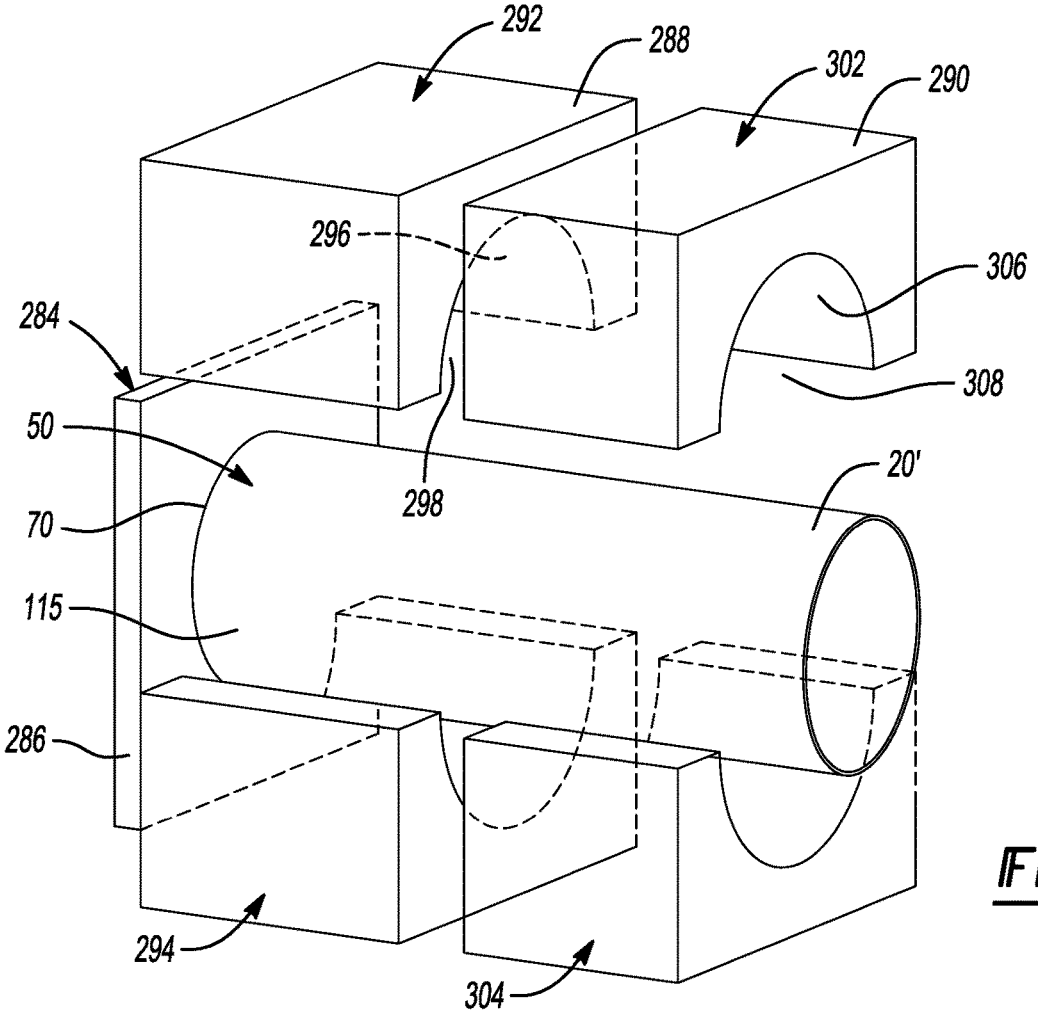
Figure 9A:
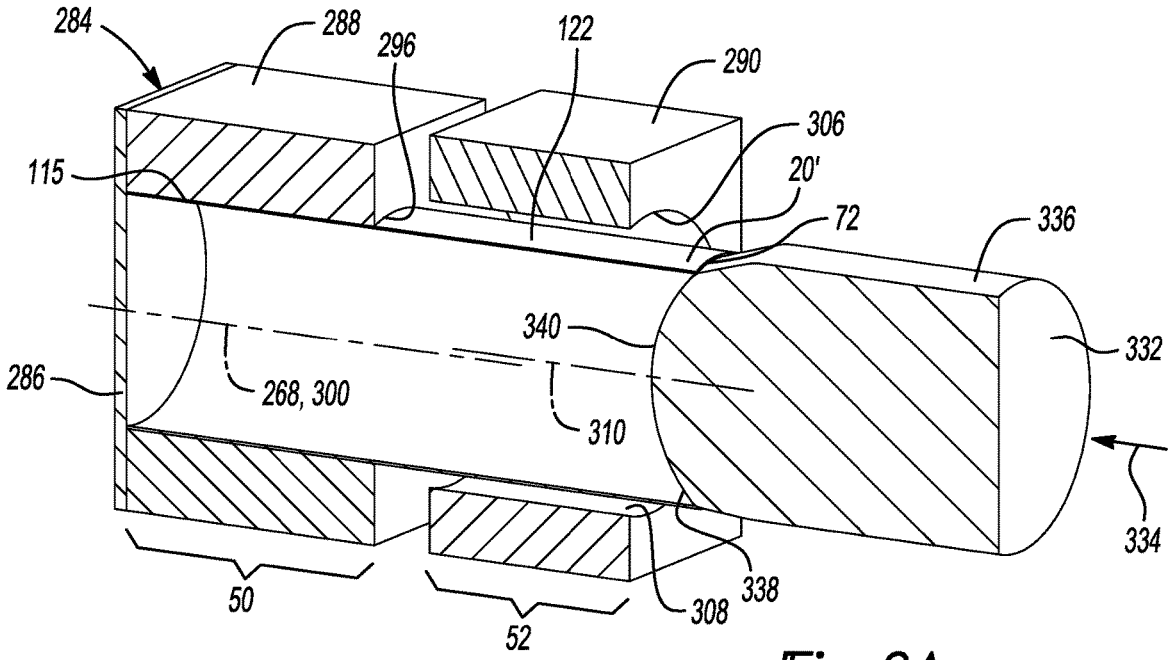
Figure 9B:
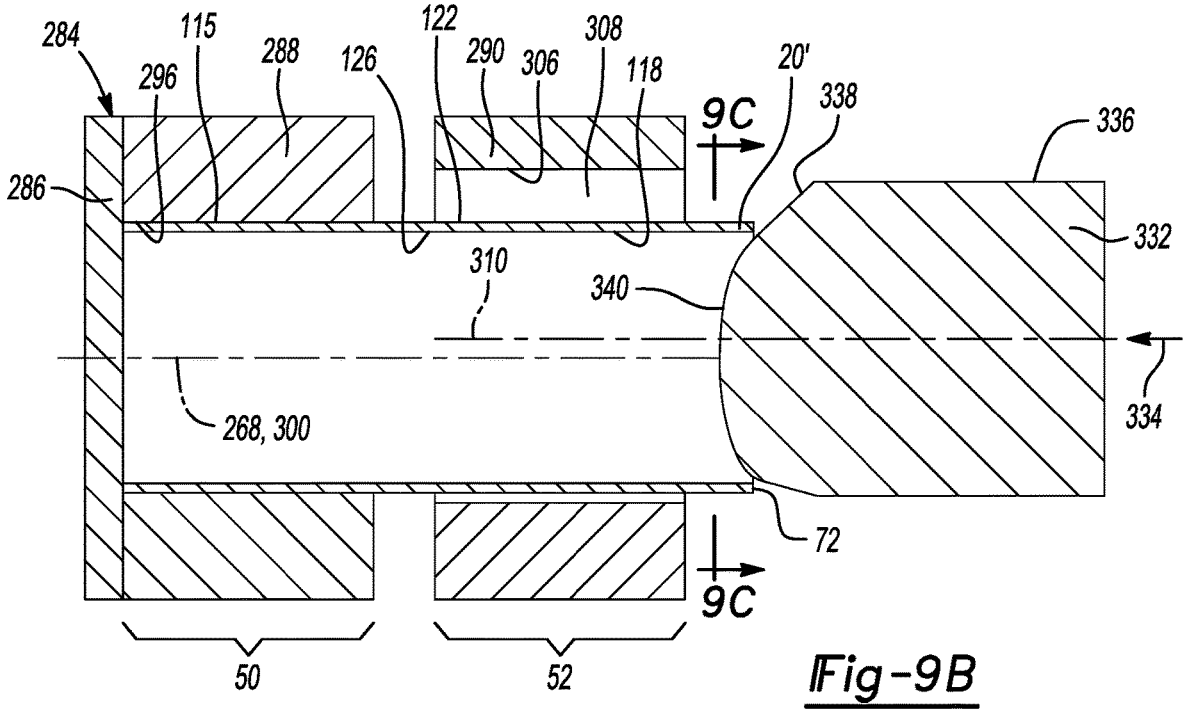
Figure 9C:
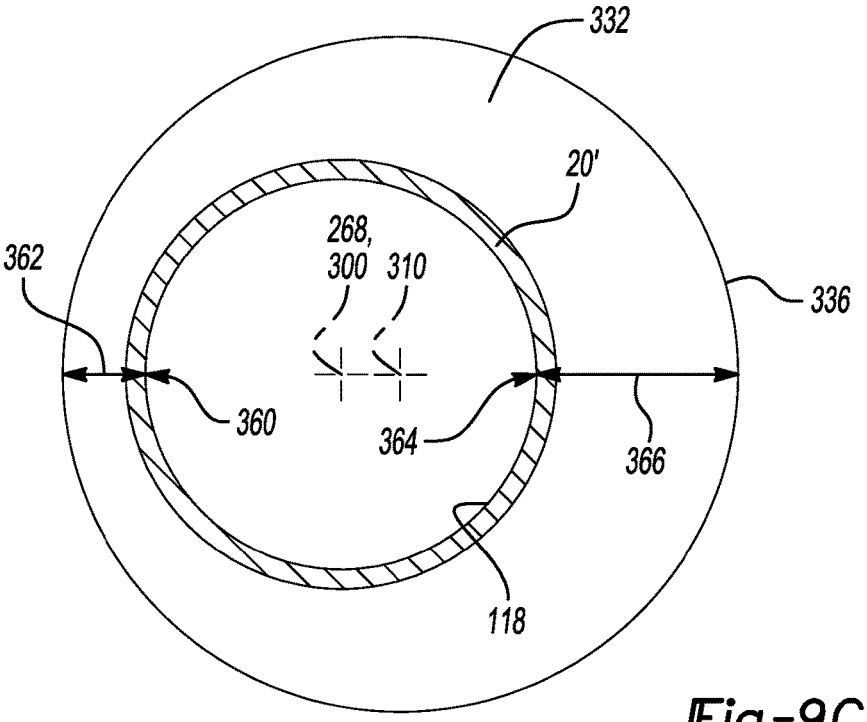
Figure 10:
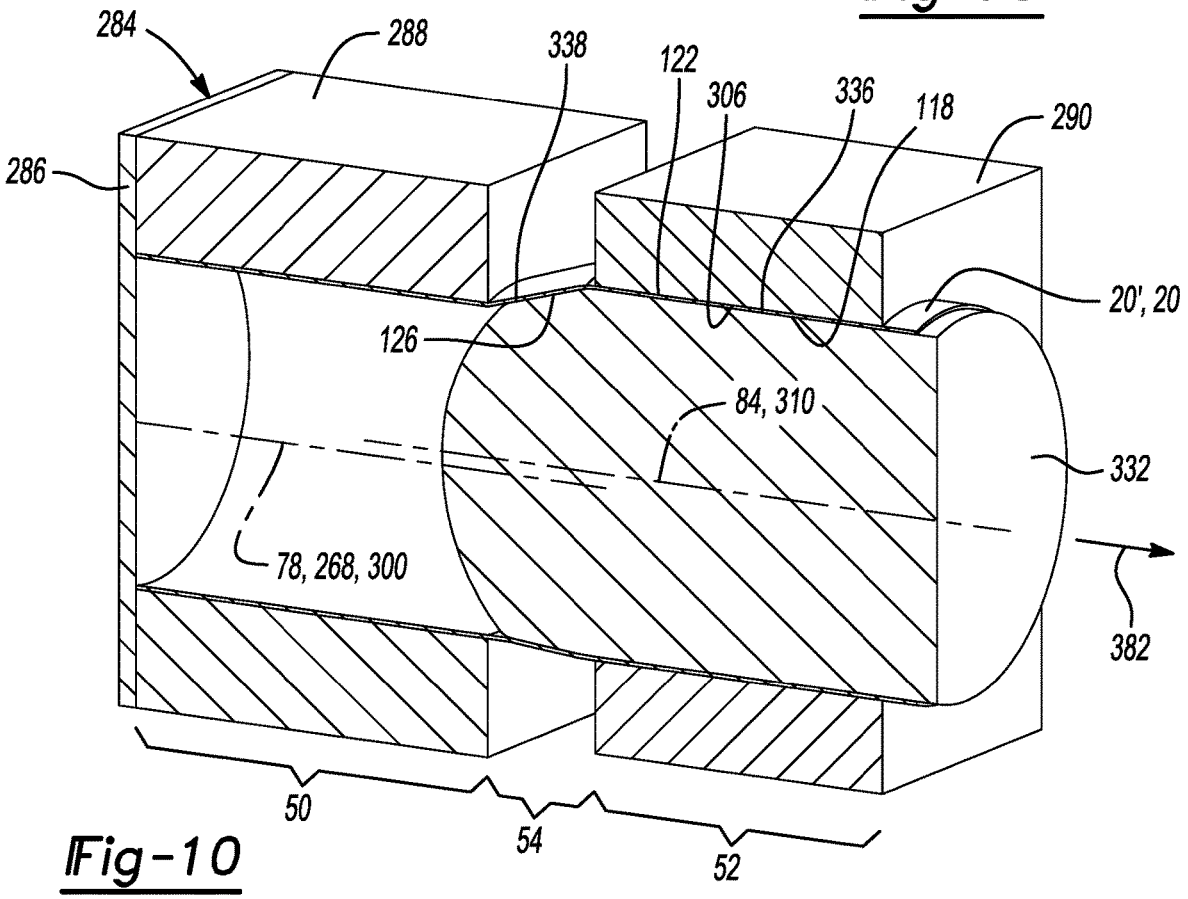

FIG. 6 is a flowchart depicting a method of manufacturing the shell of FIG. 2 according to the principles of the present disclosure; and FIGS. 7-10 are related to the method of FIG. 6; FIG. 7 is a perspective view of a tube; FIG. 8 is a perspective view of the tube disposed within a fixture; FIG. 9A is a perspective sectional view of a tool engaging an end of the tube; FIG. 9B is a sectional view of the tool engaging the tube; FIG. 9C is another sectional view of the tool engaging the tube; and FIG. 10 is a perspective sectional view of the tool deforming the tube.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
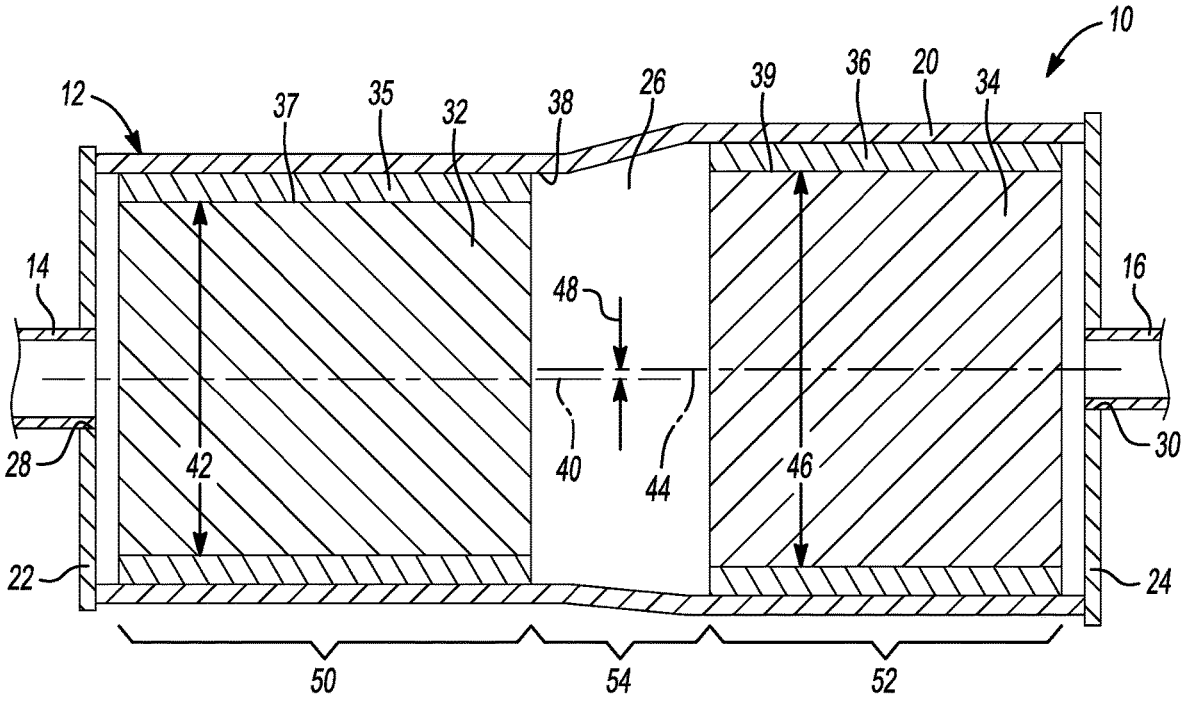
FIG. 1 is a sectional view of an exhaust treatment device according to the principles of the present disclosure.

Referring to FIG. 1, an exhaust treatment device 10 according to the principles of the present disclosure is provided. The exhaust treatment device 10 includes a housing 12 that is fluidly connected to an inlet pipe 14 and an outlet pipe 16. The housing 12 includes a single-piece, tubular shell 20, a first end cap 22, and a second end cap 24. The first and second end caps 22, 24 may be sealingly coupled to the shell 20. The shell 20 and the first and second end caps 22, 24 may cooperate to at least partially define an interior volume 26. The first end cap 22 includes an inlet opening 28 receiving the inlet pipe 14. The second end cap 24 includes an outlet opening 30 receiving the outlet pipe 16.

The exhaust treatment device 10 further includes at least two exhaust treatment components, such as a first exhaust treatment component 32 and a second exhaust treatment component 34. The first and second exhaust treatment components 32, 34 are disposed within the interior volume 26 of the housing 12. The first and second exhaust treatment components 32, 34 may be adapted to sequentially receive exhaust gas from an engine. In some embodiments, the exhaust treatment device 10 may include more than two exhaust treatment components. A quantity of exhaust treatment components may be greater than or equal to two, optionally greater than or equal to three, optionally greater than or equal to four, or optionally greater than or equal to five, by way of example.

In at least some embodiments, the first and second exhaust treatment components 32, 34 may be independently selected from the group consisting of a gasoline particulate filter (GPF), a diesel particulate filter (DPF), a diesel oxidation catalyst (DOC), a lean NOx trap (LNT), a selective catalytic reduction device (SCR), or any combination thereof. In some embodiments, the first and second exhaust treatment components 32, 34 are the same type of exhaust treatment component. In other embodiments, the first and second exhaust treatment components 32, 34 are different types of exhaust treatment components. In at least some examples, the first and/or second exhaust treatment components include ceramic substrates. A first mat 35 circumferentially surrounds a substrate of the first exhaust treatment component 32. A second mat 36 circumferentially surrounds a substrate of the second exhaust treatment component 34. The first mat 35 is compressed between a first substrate outer surface 37 and a shell inner surface 38. The second mat 36 is compressed between a second substrate outer surface 39 and the shell inner surface 38.

The first exhaust treatment component 32 may extend along a first component axis 40 and define a first transverse component dimension 42 (e.g., a first diameter) substantially perpendicular to the first component axis 40. The second exhaust treatment component 34 may extend along a second component axis 44 and define a second transverse component dimension 46 (e.g., a second diameter) substantially perpendicular to the second component axis 44. The first and second component axes 40, 44 may be offset by an amount 48. The first and second transverse component dimensions 42, 46 may be different. For example, the second transverse component dimension 46 may be larger than the first transverse component dimension 42.

The shell 20 is a one-piece, monolithic member that may include a first portion 50, a second portion 52, and a third portion 54. The third portion 54 may extend continuously between the first and second portions 50, 52. The first exhaust treatment component 32 may be disposed in the first portion 50. The second exhaust treatment component 34 may be disposed in the second portion 52. In some embodiments, the third portion 54 is open. Exhaust gas may be received in the inlet opening 28, flow through the first exhaust treatment component 32 in the first portion 50, flow through the third portion 54, flow through the second exhaust treatment component 34 in the second portion 52, and be discharged through the outlet opening 30.

Figure 3:
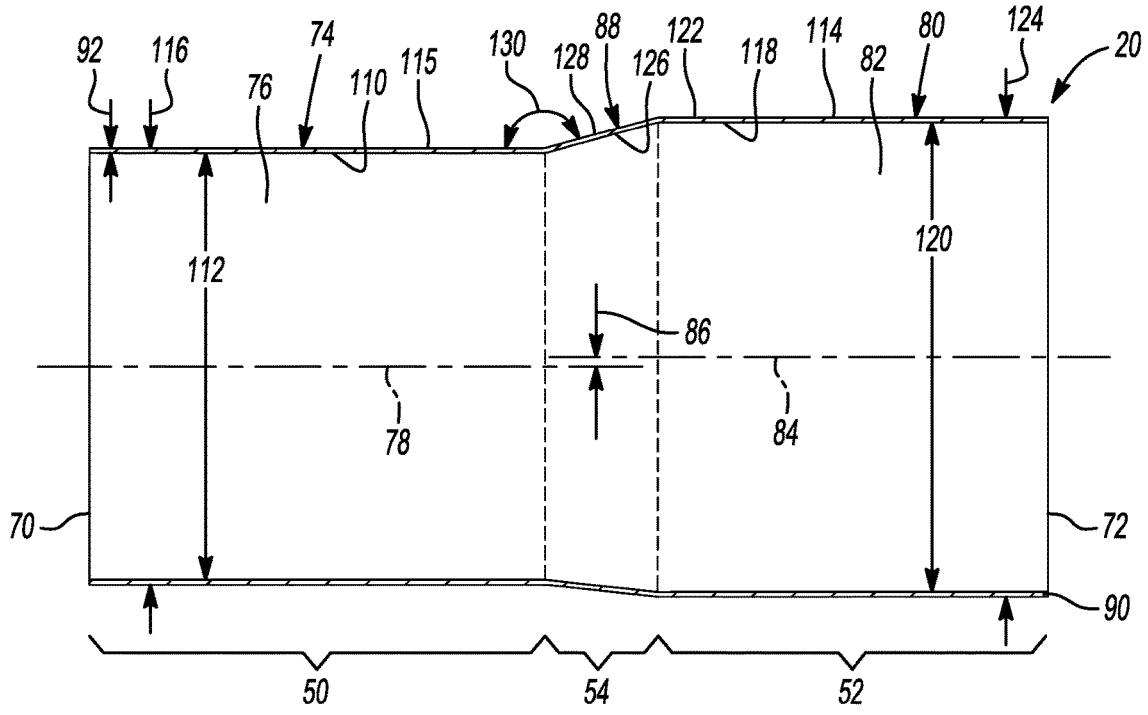
FIG. 3 is a sectional view of the shell of FIG. 2.

With reference to FIGS. 2-3, the shell 20 includes the first portion 50 disposed at a first end 70 and the second portion 52 disposed at a second end 72. The first portion 50 includes a first peripheral wall portion 74. The first peripheral wall portion 74 at least partially defines a first interior region 76. A first longitudinal axis 78 extends through the first interior region 76. The second portion 52 includes a second peripheral wall portion 80. The second peripheral wall portion 80 at least partially defines a second interior region 82. A second longitudinal axis 84 extends through the second interior region 82. The second longitudinal axis 84 is offset from the first longitudinal axis 78 by a second amount 86.

The first interior region 76 is adapted to receive the first exhaust treatment component 32 (FIG. 1). The second interior region 82 is adapted to receive the second exhaust treatment component 34 (FIG. 1). When the first exhaust treatment component 32 is disposed in the first interior region 76, the first component axis 40 (FIG. 1) may be substantially aligned with the first longitudinal axis 78. When the second exhaust treatment component 34 is disposed in the second interior region 82, the second component axis 44 (FIG. 1) may be substantially aligned with the second longitudinal axis 84.

The third portion 54 includes a third peripheral wall portion 88. The third peripheral wall portion 88 extends between the first peripheral wall portion 74 and the second peripheral wall portion 80. The third peripheral wall portion 88 connects the first peripheral wall portion 74 and the second peripheral wall portion 80. Accordingly, the first and second interior regions 76, 82 are in fluid communication with one another. The first, second, and third peripheral wall portions 74, 80, 88 are integrally formed with one another such that the shell 20 comprises a single-piece or unitary structure with the shell inner surface 38 being uninterrupted and smooth. The shell 20 may therefore be free of circumferentially-extending seams or joints, such as welds.

The first, second, and third peripheral wall portions 74, 80, 88 cooperate to form a common shell wall 90. The common shell wall 90 may have a thickness 92. As a result of manufacturing, the thickness 92 may be variable. Manufacturing may include ram forming the shell 20 from a tube (see, e.g., tube 20' of FIG. 7) having a substantially uniform initial thickness ($t_i$). After manufacturing, the thickness 92 may vary between a minimum thickness ($t_m$) and the initial thickness ($t_i$). A maximum thinning ratio (R) may be used to quantify an amount of thinning resulting from manufacturing. The thinning ratio is a ratio of a difference between the initial thickness and the minimum thickness to the initial thickness ($R=(t_i-t_m)/t_i$)). In some embodiments, the common shell wall 90 may have a maximum thinning ratio of less than or equal to about 25%, optionally less than or equal to about 20%, optionally less than or equal to about 15%, optionally less than or equal to about 12%, optionally less than or equal to about 10%, optionally less than or equal to about 9%, optionally less than or equal to about 8%, optionally less than or equal to about 7%, optionally less than or equal to about 6%, or optionally less than or equal to about 5%.

In some embodiments, the first portion 50 has a substantially circular cross section perpendicular to the first longitudinal axis 78. Accordingly, the first portion 50 may be substantially cylindrical. However, in other embodiments, the first portion 50 may have a non-circular cross-sectional shape, such as an oval, an ellipse, or a stadium. In some embodiments, the second portion 52 has a substantially circular cross section perpendicular to the second longitudinal axis 84. Accordingly, the second portion 52 may be substantially cylindrical. However, in other embodiments, the second portion 52 may have a non-circular cross-sectional shape, such as an oval, an ellipse, or a stadium. The first and second portions 50, 52 may define the same type of shape or different types of shapes. In some embodiments, both of the first and second portions 50, 52 are substantially cylindrical. In some embodiments, the third portion 54 has a substantially circular cross section. Accordingly, the entire shell 20 may have a substantially circular cross section.

The shell inner surface 38 has a first inner surface portion 110 along the first portion 50. The first inner surface portion 110 has a first transverse inner dimension 112 (e.g., first inner diameter). A shell outer surface 114 has a first outer surface portion 115. The first outer surface portion 115 has a first transverse outer dimension 116 (e.g., first outer diameter).

The shell inner surface 38 has a second inner surface portion 118 along the second portion 52. The second inner surface portion 118 has a second inner transverse dimension 120 (e.g., second inner diameter). The shell outer surface 114 includes a second outer surface portion 122 along the second portion 52. The second outer surface portion 122 has a second transverse outer dimension 124 (e.g., second outer dimension). The first and second transverse inner dimensions 112, 120 may be different. For example, the second transverse inner dimension 120 may be greater than the first transverse inner dimension 112. The first and second transverse outer dimensions 116, 124 may be different. For example, the second transverse outer dimension 124 may be greater than the first transverse inner dimension 112.

The shell inner surface 38 may have a third inner surface portion 126. The third inner surface portion 126 may have the first transverse inner dimension 112 adjacent to the first portion 50 and the second transverse inner dimension 120 adjacent to the second portion 52. The shell outer surface 114 may have a third outer surface portion 128. The third outer surface portion 128 may have the first transverse outer dimension 116 adjacent to the first portion 50 and the second transverse outer dimension 124 adjacent to the second portion 52. The third peripheral wall portion 88 may be sloped between the first peripheral wall portion 74 and the second peripheral wall portion 80. Thus, the third peripheral wall portion 88 may extend non-parallel to the first and second longitudinal axes 78, 84.

The third peripheral wall portion 88 may form an angle 130 with the first peripheral wall portion 74. Due to the offset first and second longitudinal axes 78, 84, the angle 130 may be variable. The angle 130 is greater than 90° and less than or equal to about 180°. In some embodiments, the angle 130 may range from greater than or equal to about 135° to less than or equal to about 180°, optionally greater than or equal to about 150° to less than or equal to about 180°, or optionally greater than or equal to about 160° to less than or equal to about 180°.

Figure 4:
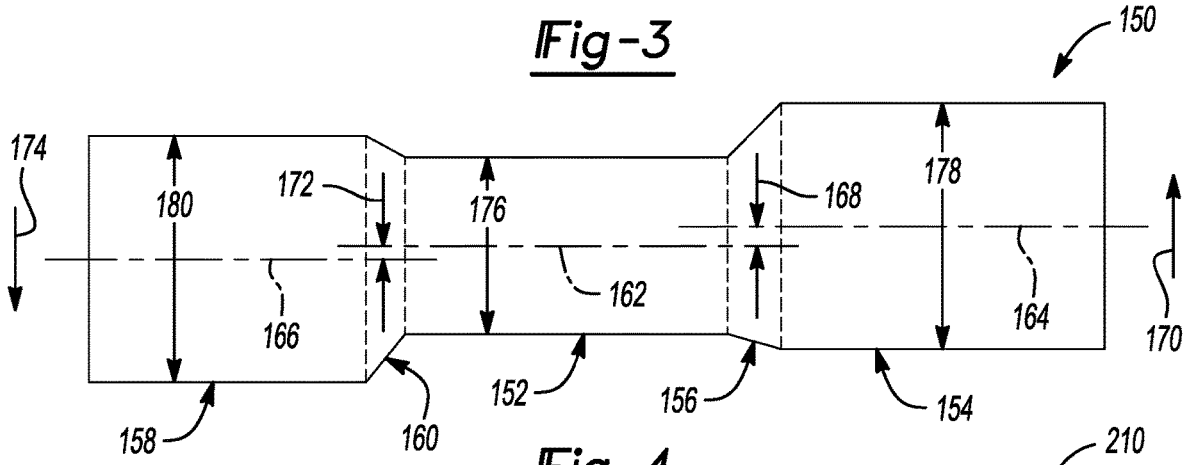
FIG. 4 is a side view of another shell according to the principles of the present disclosure.

Referring to FIG. 4, another single-piece, tubular shell 150 according to the principles of the present disclosure is provided. The shell 150 includes a first portion 152, a second portion 154, a third portion 156, a fourth portion 158, and a fifth portion 160. The first, second, and fourth portions 152, 154, and 158 are adapted to receive exhaust aftertreatment components (see, e.g., exhaust treatment components 32, 34 of FIG. 1). The first portion 152 is disposed between the second and fourth portions 154, 158. The third portion 156 extends between and connects the first and second portions 152, 154. The fifth portion 160 extends between and connects the first and fourth portions 152, 158.

The first, second, and fourth portions 152, 154, 158 extend along respective first, second, and third longitudinal axes 162, 164, 166. Each of the second and third longitudinal axes 164, 166 may be non-coaxially aligned with the first longitudinal axis 162. The second longitudinal axis 164 may be offset from the first longitudinal axis 162 by a first amount 168 in a first direction 170. The third longitudinal axis 166 may be offset from the first longitudinal axis 162 by a second amount 172 in a second direction 174. The first and second amounts 168, 172 may be the same or different. The first and second directions 170, 174 may be different as shown, or the first and second directions 170, 174 may be the same.

The first, second, and fourth portions 152, 154, 158 may define respective first, second, and third transverse dimensions (e.g., diameters) 176, 178, 180. The second and third transverse dimensions 178, 180 may each be greater than the first transverse dimension 176. The second and third transverse dimensions 178, 180 may be the same or different.

Figure 5:
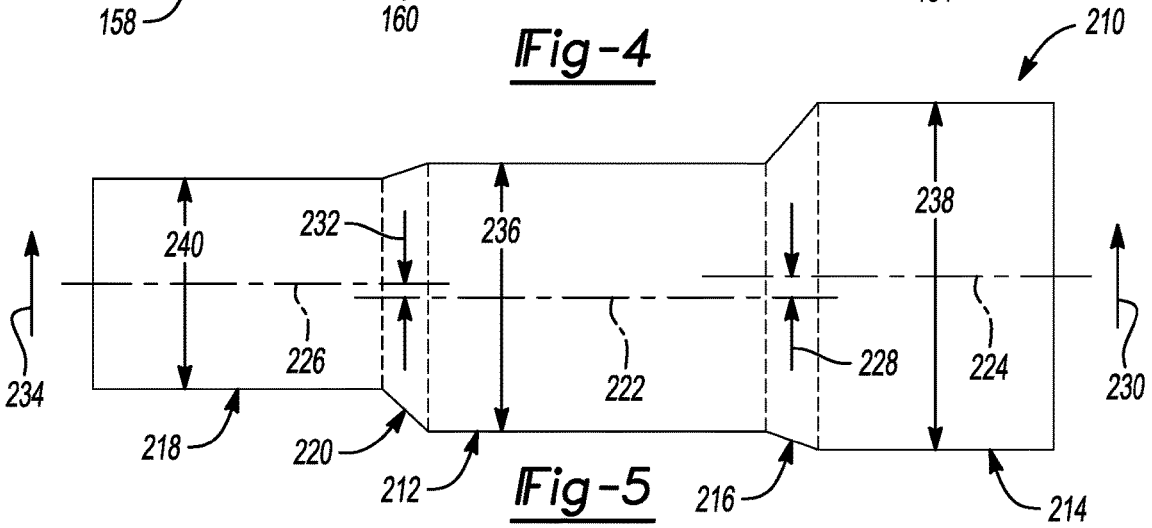
FIG. 5 is a side view of yet another shell according to the principles of the present disclosure.

With reference to FIG. 5, yet another single-piece, tubular shell 210 according to the principles of the present disclosure is provided. The shell 210 includes a first portion 212, a second portion 214, a third portion 216, a fourth portion 218, and a fifth portion 220. The first, second, and fourth portions 212, 214, 218 are adapted to receive exhaust treatment components (see, e.g., exhaust treatment components 32, 34 of FIG. 1). The first portion 212 is disposed between the second and fourth portions 214, 218. The third portion 216 extends between and connects the first and second portions 212, 214. The fifth portion 220 extends between and connects the first and fourth portions 212, 218.

The first, second, and fourth portions 212, 214, 218 extend along respective first, second, and third longitudinal axes 222, 224, 226. Each of the second and third longitudinal axes 224, 226 may be non-coaxially aligned with the first longitudinal axis 222. The second longitudinal axis 224 may be offset from the first longitudinal axis 222 by a first amount 228 in a first direction 230. The third longitudinal axis 226 may be offset from the first longitudinal axis 222 by a second amount 232 in a second direction 234. The first and second amounts 228, 232 may be the same or different. The first and second directions 230, 234 may be the same, as shown, of the first and second directions 230, 234 may be different.

The first, second, and fourth portions 212, 214, 218 may define respective first, second, and third transverse dimensions 236, 238, 240 (e.g., diameters). The first dimension 236 may be greater than the third dimension 240. The second dimension 238 may be greater than both the third dimension 240 and the first dimension 236.

With reference to FIGS. 6-10, a method of manufacturing the shell 20 from a tube 20' according to the principles of the present disclosure is provided. The method may include ram-forming at least a portion of the tube 20' to deform the tube 20' and form the shell 20. The tube 20' may also be referred to as an undeformed shell 20' or a shell precursor 20'. The tube 20' is described as having the same portions (i.e., first, second, and third portions 50, 52, 54), surfaces (i.e., shell inner surface 38 and shell outer surface 114), and surface portions (i.e., first, second, and third inner surface portions 110, 118, 126 and first, second, and third outer surface portions 115, 112, 128) as the shell 20.

At step 260, the method includes providing the tube 20', as shown in FIG. 7A. The tube 20' may be monolithic. The tube 20' may extend between the first end 70 and the second end 72 along an initial longitudinal axis 268. The tube 20' may have an initial thickness 270. In some embodiments, the tube 20' may be substantially cylindrical. The tube 20' may comprise a metal, such as stainless steel, by way of example. In at least some embodiments, the tube 20' may have the first transverse inner dimension 112 and the first transverse outer dimension 116.

Steps 274, 278, and 282 relate to supporting the tube 20' in a fixture 284, as shown in FIG. 8. The fixture 284 may include a stop 286, a first clamp die 288, and a second clamp die 290. The first clamp die 288 may abut the stop 286. The second clamp die 290 may be longitudinally spaced apart from the first clamp die 288.

In certain variations, the first clamp die 288 may include a first upper portion 292 and a first lower portion 294, as shown. However, in other variations, the first clamp die 288 is a single-piece die. The first upper and lower portions 292, 294 are adapted to cooperate to clamp the first portion 50 of the tube 20'. When the first upper and lower portions 292, 294 are clamped together, the first clamp die 288 includes an inner clamp surface 296. The inner clamp surface 296 may be substantially cylindrical. A first inner area 298 may be disposed between the first upper and lower portions 292, 294 of the first clamp die 288. The first inner area 298 may be adapted to receive the tube 20'. A first clamp axis 300 (FIG. 9A) may extend through the first inner area 298.

In certain variations, the second clamp die 290 may include a second upper portion 302 and a second lower portion 304. However, in other variations, the second clamp die 290 may be a single-piece die. The second upper and lower portions 302, 304 are adapted to cooperate to be disposed around the second portion 52 the tube 20'. When the second upper and lower portions 302, 304 are clamped together, the second clamp die 290 includes an inner clamp surface 306. The inner clamp surface 306 may be substantially cylindrical. A second inner area 308 may be disposed between the second upper and lower portions 302, 304. The second inner area 308 may be adapted to receive the tube 20'. A second clamp axis 310 (FIG. 9A) may extend through the second inner area 308. The second clamp axis 310 may be non-coaxially aligned with the first clamp axis 300.

At step 274, the method may include restricting movement of the tube 20'. Restricting movement of the tube 20' may include abutting the first end 70 of the tube 20' with the stop 286.

At step 278, the method may include disposing the first portion 50 of the tube 20' within the first clamp die 288. More particularly, the first portion 50 of the tube 20' may be received in the first inner area 298 of the first clamp die 288. The inner clamp surface 296 of the first clamp die 288 may be spaced apart from the first outer surface portion 115 of the tube 20'. Step 278 may be performed after, concurrently with, or before step 274.

At step 282, the method may include clamping the first portion 50 of the tube 20' within the first clamp die 288, as shown in FIGS. 9A-9C. When the first portion 50 of the tube 20' is clamped, the inner clamp surface 296 of the first clamp die 288 engages the first outer surface portion 115 of the tube 20'. The initial longitudinal axis 268 may be substantially aligned with the first clamp axis 300.

At step 320, the method may further include disposing a second portion 52 of the tube 20' within the second clamp die 290. More particularly, the second portion 52 of the tube 20' is received by the second inner area 308 of the second clamp die 290. The inner clamp surface 306 of the second clamp die 290 may be spaced apart from the second outer surface portion 122. Step 320 may be performed after, concurrently with, or before step 278.

At step 330, the method may further including translating a tool 332 into the second end 72 of the tube 20'. The tool 332 may be translated in a first direction 334 toward the second end 72 of the tube 20', as shown in FIGS. 9A-9C. The first direction 334 may be substantially parallel to or coaxially aligned with the second clamp axis 310.

The tool 332 may include a first outer tool surface 336, a second outer tool surface 338, and a third outer tool surface 340. The tool 332 is sufficiently tapered along the second outer tool surface 338 to allow the third outer tool surface 340 to enter the second end 72 of the tube 20' (e.g., the second interior region 82) while being coaxially aligned with the second clamp axis 310 and second longitudinal axis 84 (FIG. 3). The first outer tool surface 336 may be sized and shaped to complement the second inner surface portion 118 of the shell 20 to be formed (FIGS. 2-3). The second outer tool surface 338 may be sized and shaped to complement the third inner surface portion 126 of the shell 20 to be formed (FIGS. 2-3). The third outer tool surface 340 may be rounded. The second outer tool surface 338 may be disposed between the first and third outer tool surfaces 336, 340. Step 330 may further include applying a lubricant to the tool 332 and/or the inner surface 38 of the tube 20' prior to or during translation of the tool 332.

At step 350, concurrently with translating the tool 332 at step 330, the method may further include deforming at least a portion of the tube 20' to form the shell 20. Deforming the tube 20' may include operatively engaging the tool 332 with the tube 20'. The tool 332 engages the second portion 52 of the tube 20'. More particularly, as shown in FIG. 9C, a portion 360 (e.g., a first circumferential portion) of the tube 20' is closer to the first outer tool surface 336, as indicated by a first distance 362, than a diametrically opposed portion 364 (e.g., a second circumferential portion) of the tube 20', as indicated by a distance 366. It should be appreciated that the tool 332 deforms some portions of the tube 20' (e.g., the second circumferential portion) to a greater extent than other portions of the tube 20' (e.g., the first circumferential portion) based on the initial spacing of the tube 20' from the inner clamp surface 306 of the second clamp die 290 (FIGS. 9A-9B).

The second inner surface portion 118 of the tube 20' conforms to the first outer tool surface 336 to expand the tube 20' to have the second transverse inner dimension 120 of the shell 20 (FIG. 3). The second outer surface portion 122 conforms to the inner clamp surface 306 of the second clamp die 290 such that the second outer surface portion 122 has the second transverse outer dimension 124 of the shell 20 (FIG. 3). The second longitudinal axis 84 of the second portion 52 of the shell 20 is substantially aligned with the second clamp axis 310. Thus, deforming the tube 20' at step 350 includes transversely shifting the second portion 52 of the tube 20' from the initial longitudinal axis 268 to the second longitudinal axis 84. The second longitudinal axis 84 is non-coaxially aligned with the initial longitudinal axis 268 of the tube 20' and the first clamp axis 300.

The tool 332 may also engage the third portion 54 of the tube 20'. More particularly, the third inner surface portion 126 conforms to the second outer tool surface 338 to form the angle 130 (FIG. 3) of the shell 20. The third outer surface portion 128 may remain unsupported during deforming the tube 20'.

The first portion 50 may remain undeformed during step 350. Thus, the first transverse inner dimension 112 (FIG. 3) and the first transverse outer dimension 116 (FIG. 3) of the first portion 50 may be maintained step 350. The first longitudinal axis 78 of the shell 20 may be substantially coaxially aligned with the initial longitudinal axis 268 of the tube 20' and the initial longitudinal axis 268.

The method may optionally include additional steps. In some embodiments, the method further includes ram-forming the first portion 50 of the tube 20' with a different tool in a similar manner as described above, such as when the tube 20' does not have the first transverse inner dimension 112 and the first transverse outer dimension 116. In some embodiments, the method may further include ram-forming other portions of a shell (e.g., fourth and fifth portions 158, 160 of shell 150 of FIG. 4 or fourth and fifth portions 218, 220 of shell 210 of FIG. 5).

At 380, the method may further include removing the tool 332 from the shell 20. Removing the tool 332 from the shell 20 may include translating the tool 332 in a second direction 382 opposite the first direction 334. Step 380 may be performed after completion of step 350. At 390, the method may further include removing the shell 20 from the first and second clamp dies 288, 290 of the fixture 284. Step 390 may be performed after completion of step 350.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exhaust treatment device for receiving exhaust gas from an engine of a vehicle, the exhaust treatment device comprising:

a tubular single-piece shell including, a first peripheral wall portion at least partially defining a first interior region having a first longitudinal axis extending therethrough, a second peripheral wall portion at least partially defining a second interior region having a second longitudinal axis extending therethrough, the second longitudinal axis being parallel to and non-coaxially aligned with the first longitudinal axis, and a third peripheral wall portion extending between and connecting the first peripheral wall portion and the second peripheral wall portion such that the first interior region and the second interior region are in fluid communication, the first peripheral wall portion, the second peripheral wall portion, and the third peripheral wall portion being integrally formed and defining a uninterrupted, smooth shell inner surface;

a first exhaust treatment component disposed within the first interior region; and a second exhaust treatment component disposed within the second interior region, wherein the first interior region is in fluid communication with an inlet opening adapted to receive exhaust gas and the second interior region is in fluid communication with an outlet opening adapted to discharge exhaust gas.

2. The exhaust treatment device of claim 1, wherein the first peripheral wall portion has a first transverse inner dimension and the second peripheral wall portion has a second transverse inner dimension different from the first transverse inner dimension.

3. The exhaust treatment device of claim 2, wherein the third peripheral wall portion is sloped between the first peripheral wall portion and the second peripheral wall portion such that it extends non-parallel to the first longitudinal axis and the second longitudinal axis.

4. The exhaust treatment device of claim 1, wherein the first longitudinal axis extends parallel to and offset from the second longitudinal axis.

5. The exhaust treatment device of claim 1, wherein the first peripheral wall portion has a first transverse outer dimension and the second peripheral wall portion has a second transverse outer dimension different from the first transverse outer dimension.

6. The exhaust treatment device of claim 1, wherein the first peripheral wall portion and the second peripheral wall portion are substantially cylindrical.

7. The exhaust treatment device of claim 1, wherein the third peripheral wall portion has a substantially circular cross section.

8. The exhaust treatment device of claim 1, wherein the first peripheral wall portion, the second peripheral wall portion, and the third peripheral wall portion cooperate to form a shell wall having a maximum thinning ratio of less than or equal to about 25%.

9. The exhaust treatment device of claim 1, wherein the maximum thinning ratio is less than or equal to about 10%.

10. The exhaust treatment device of claim 1, wherein the shell further includes, a fourth peripheral wall portion at least partially defining a third interior region having a third longitudinal axis extending therethrough, the third longitudinal axis being non-coaxially aligned with at least one of the first longitudinal axis and the second longitudinal axis, and a fifth peripheral wall portion extending between and connecting the first peripheral wall portion and the fourth peripheral wall portion, wherein the first peripheral wall portion, the second peripheral wall portion, the third peripheral wall portion, the fourth peripheral wall portion, and the fifth peripheral wall portion are integrally formed and define the uninterrupted, smooth shell inner surface.

11. The exhaust treatment device of claim 1, wherein the first exhaust treatment component and the second exhaust treatment component are independently selected from the group consisting of a gasoline particulate filter, a diesel particulate filter, a diesel oxidation catalyst, a lean NOx trap, a selective catalytic reduction device, or any combination thereof.

12. A method of manufacturing a shell for an exhaust treatment device, the method comprising:

restricting movement of a first end of a monolithic tube having an inner surface and an outer surface, and a first longitudinal axis;

clamping a first portion of the tube within a first clamp die having a first clamp axis extending therethrough, the first longitudinal axis of the tube being substantially aligned with the first clamp axis, an inner surface of the first clamp die engaging the outer surface of the tube along the first portion;

disposing a second portion of the tube within a second clamp die, an inner clamp surface of the second clamp die being spaced apart from the outer surface of the tube along the second portion, the second clamp die having a second clamp axis extending therethrough, the second clamp axis being non-coaxially aligned with the first clamp axis;

translating a tool into a second end of the tube opposite the first end of the tube;

deforming the tube while continuing to translate the tool and operatively engaging the tool with the inner surface of the tube such that the inner surface conforms to a first outer tool surface, the tool deforming the tube to conform the outer surface of the tube along the second portion to the inner clamp surface of the second clamp die, and substantially align a second longitudinal axis of the second portion with the second clamp axis;

removing the tool from the tube; and removing the tube from the first clamp die and the second clamp die.

13. The method of claim 12, wherein the second clamp die is longitudinally spaced apart from the first clamp die.

14. The method of claim 12, wherein deforming the tube further comprises operatively engaging the tool with a third portion of the tube such that the inner surface of the tube along the third portion conforms to a second outer tool surface, the third portion being disposed longitudinally between the first portion and the second portion.

15. The method of claim 14, wherein the outer surface of the tube along the third portion is unconstrained during creating the shell.

16. The method of claim 12, wherein the tube defines a wall thickness and deforming the tube yields a thinning ratio of less than or equal to about 10%.

17. The method of claim 12, further comprising maintaining a first inner dimension of the first portion of the tube during translation of the tool.

18. The method of claim 12, wherein deforming the tube includes radially outwardly expanding all portions of the second portion of the tube.

19. The method of claim 18, wherein deforming the tube includes expanding a first circumferential portion of the second portion of the tube to a lesser extent than a second circumferential portion of the tube.

20. The method of claim 12, wherein deforming the tube includes transversely shifting the second portion of the tube from the first longitudinal axis to the second longitudinal axis, the second longitudinal axis being non-coaxially aligned with the first longitudinal axis.

* * * * *